US005487695A

United States Patent [19]

Shank

[11] Patent Number: 5,487,695

[45] Date of Patent: Jan. 30, 1996

[54] BLAST NOZZLE COMBINED WITH MULTIPLE TIP WATER ATOMIZER

[75] Inventor: James D. Shank, Vestal, N.Y.

[73] Assignee: Church & Dwight Co., Inc., Princeton, N.J.

[21] Appl. No.: 169,774

[22] Filed: Dec. 17, 1993

Related U.S. Application Data

[63] Continuation-in-part of Ser. No. 958,552, Oct. 8, 1992, Pat. No. 5,319,894.

[51] Int. Cl.[6] ..... B24C 5/04

[52] U.S. Cl. ..... 451/102; 451/90

[58] Field of Search ..... 451/102, 75, 90, 451/99, 101, 91, 38, 39, 40

[56] References Cited

U.S. PATENT DOCUMENTS

| | | | |
|---|---|---|---|
| 2,644,275 | 7/1953 | Hoguet | 451/102 |
| 4,903,559 | 2/1990 | Landeck | 83/53 |
| 5,319,894 | 6/1994 | Shank, Jr. | 451/102 |

*Primary Examiner*—Robert A. Rose
*Attorney, Agent, or Firm*—Charles B. Barris

[57] ABSTRACT

A blast nozzle for directing a stream of abrasive particles against a surface to remove surface contaminants therefrom further includes multiple water atomization nozzles which are spaced externally on the blast nozzle and which direct a stream of atomized water droplets which surround the abrasive particle stream directed to the surface so as to suppress dust formation.

20 Claims, 3 Drawing Sheets

BLAST NOZZLE COMBINED WITH MULTIPLE TIP WATER ATOMIZER

This application is a continuation-in-part of U.S. Ser. No. 07/958,552, filed Oct. 8, 1992, now U.S. Pat. No. 5,319,894.

BACKGROUND OF THE INVENTION

1. Field of the Invention

The present invention relates generally to blast nozzles and a process for removing adherent material such as paint, scale, dirt, grease and the like from solid surfaces with abrasive particles propelled by air. In particular, the present invention is directed to a novel blast nozzle having an improved water atomizer means useful to control the dust caused by blasting with an abrasive and friable media such as sand or sodium bicarbonate.

2. Description of the Prior Art

In order to clean a solid surface so that such surface can again be coated such as, for example, to preserve metal against deterioration, or simply to degrease a solid surface such as surfaces contacting food or building structures which contain food serving or food processing operations, it has become common practice to use an abrasive blasting technique. In such process, abrasive particles are propelled by a high pressure fluid against the solid surface in order to dislodge previously applied coatings, scale, dirt, grease or other contaminants. Various abrasive blasting techniques have been utilized to remove the coatings, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water typically 3,000 psi and above, multi-step processes comprising dry or wet blasting and a mechanical technique such as sanding, chipping, etc. and a single step process in which both air and water are utilized either in combination at high pressures to propel the abrasive blast media to the surface as disclosed in U.S. Pat. No. 4,817,342, or in combination with relatively low pressure water used as a dust control agent or to control substrate damage have been used. Water for dust control has been mixed with the air either internally in the blast nozzle or at the targeted surface to be cleaned and such latter process, although primarily a dry blasting technique, is considered wet blasting inasmuch as media recovery and clean up is substantially different from that utilized in a purely dry blasting operation.

A typical dry blasting apparatus as well as a wet blasting apparatus which utilizes highly pressurized air to entrain, carry and direct the abrasive blast media to the solid surface to be treated and low pressure water for dust control comprises a dispensing portion in which the blast media typically contained in a storage tank is entrained in highly pressurized air, a flexible hose which carries the air/blast media mixture to the blast nozzle and which allows the operator to move the blast nozzle relative to the surface to be cleaned and the blast nozzle which accelerates the abrasive blast media and directs same into contact with the surface to be treated. Water is added either internally in the blast nozzle and mixed with the air stream passing therethrough or a low pressure stream of water is provided externally of the blast nozzle and directed at the surface to be treated so as to control dust. The blast nozzle is typically hand-held by the operator and moved relative to the targeted surface so as to direct the abrasive blast media across the entire surface to be treated.

The blast media or abrasive particles most widely used for blasting surfaces to remove adherent material therefrom is sand. Sand is a hard abrasive which is very useful in removing adherent materials such as paint, scale and other materials from metal surfaces such as steel. While sand is a most useful abrasive for each type of blasting technique, there are disadvantages in using sand as a blast media. For one, sand, i.e., silica, is friable and upon hitting a metal surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot readily be used as an abrasive to remove coatings from relatively soft metals such as aluminum or any other soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to non-soluble blast media such as sand, in particular, for removing adherent coatings from relatively soft substrates such as softer metals as aluminum, composite surfaces, plastics, concrete and the like is sodium bicarbonate. While sodium bicarbonate is softer than sand, it is sufficiently hard to remove coatings from aluminum surfaces and as well remove other coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. Unfortunately, sodium bicarbonate, typically used as particles having average diameters of from about 50 to 1,000 microns, is even more friable than sand and breaks into smaller particles as it traverses the flexible supply hose which carries the blast media and pressurized air to the blast nozzle and, as well, breaks into pieces as the blast media comes into contact with the internal surfaces of the blast nozzle prior to being propelled to the target surface. As the sodium bicarbonate media contacts the surface to be treated, even smaller particles are formed yielding a substantial amount of dust which invades the targeted area and closely surrounding environment, hindering the operator's vision of the targeted surface. Accordingly, it has become necessary to control the dust which is formed upon blasting with the very friable sodium bicarbonate blast media.

As expressed above, it is possible to control dust by injecting a low pressure stream of water into the air stream which propels the blast media. This has been accomplished by two distinct methods. In one method, the blast nozzle is provided with a water port in which water is injected into the blast nozzle to mix with the air stream and entrained blast media particles. This method has been very effective in controlling the dust of the sodium bicarbonate particles subsequent to contacting the targeted surface. Unfortunately, in view of the low density of the sodium bicarbonate particles and the water solubility thereof, the velocity of the media particles is reduced by the water and consequently, the productivity with respect to cleaning the targeted surface is substantially decreased by this method. Thus, defining performance of a blast nozzle as the rate in which a volume of coating is removed per time, injecting the water with the air stream which propels the blast media has greatly reduced the production rate for the reasons expressed above.

An alternative method has been to direct the low pressure water stream externally from the blast nozzle at the targeted surface to control the dust which forms at the contact point. While this process has yielded improved productivity relative to the internally directed water stream, dust control is only slightly improved relative to dry blasting and substantially inferior to the process in which the water stream is directed internally in the blast nozzle. In view of the advantages of utilizing sodium bicarbonate as a blast media as enumerated above, including water solubility to improve clean up, less harmful to the environment and useful to clean a wide variety of different surface types, it certainly would be most advantageous to improve the processes and apparatus for using same. In particular, it would be most advantageous to reduce the dust associated with the sodium bicarbonate blast media and, at the same time, maintain the productivity found using sodium bicarbonate as a blast media in dry blasting.

An improved blast nozzle for directing an abrasive media against a targeted surface in a pressurized air stream for the removal of surface coatings, scale, dirt, grease, etc. and to reduce dust formation is described in copending, commonly assigned U.S. Ser. No. 07/958,552, filed Oct. 8, 1992. As disclosed therein, the blast nozzle is provided with an external source of atomized water which is also directed at the targeted surface so as to control the formation of dust. The atomized water is achieved by an atomization nozzle in which air and water are mixed and directed from the nozzle in drops having a diameter of about 15 to 100 microns. The atomized water is directed at the targeted surface at a location to meet deflected abrasive media particles which have contacted the targeted surface and coalesces or otherwise precipitates the minute particles of blast media, thus greatly reducing the dust which is formed. At the same time, the minute atomized water particles provided at low pressure and externally from the blast nozzle do not substantially interfere with the media flow from the blast nozzle to the targeted surface and, thus, maximum velocity of the blast media is substantially maintained and productivity for stripping or cleaning the targeted surface is maintained at high levels, approaching those levels achieved for purely dry blasting operations.

The nozzle of the above-described application is substantially more effective in controlling dust and maintaining the productivity of the nozzle than previous blast nozzles which used other dust control techniques. However, it was found that with one water atomization nozzle mounted on the blast nozzle, dust control can still be improved. Additionally, the water atomization nozzle was disclosed as being mounted adjacent to the outlet of the blast nozzle. Consequently, the atomized water droplets issuing from the water atomization nozzle were not in contact with the dust cloud long enough to coalesce the dust particles before the water droplets contacted the targeted surface.

Accordingly, an object of the present invention is to provide a blast nozzle which can provide good dust control when utilizing a friable blast media to clean a targeted surface.

Another object of the present invention is to provide an improved blast nozzle which is useful in directing an abrasive but friable blast media against a targeted surface for the cleaning thereof without yielding excessive dust and, at the same time, maintaining the productivity of the nozzle at high levels.

Still another object of the present invention is to provide a blast nozzle useful in directing sodium bicarbonate in a stream of air against a targeted surface for the cleaning thereof and capable of controlling the dust which results when the sodium bicarbonate blast media contacts the targeted surface.

SUMMARY OF THE INVENTION

In accordance with the present invention, a blast nozzle for directing an abrasive media against a targeted surface in a pressurized air stream for the removal of surface coatings, scale, dirt, grease, etc. is provided with an improved water atomizer means which is directed at the targeted surface so as to better control the formation of dust. The improved water atomizer means includes multiple atomization nozzles placed around the exterior of the blast nozzle. The water atomization nozzles are directed at the targeted surface and provide an increased amount of mist to coalesce or otherwise precipitate the minute particles of blast media which are formed upon contact with the target surface, thus greatly reducing the dust which is formed. At the same time, the water atomization nozzles are placed externally on the blast nozzle in a location so as not to substantially interfere with the abrasive media flow from the blast nozzle to the targeted surface. Maximum velocity of the blast media is therefore substantially maintained and productivity for stripping or cleaning the targeted surface is maintained at high levels. Finer droplets of atomized water for dust control are provided by mounting the water atomization nozzles back from the outlet of the blast nozzle. Optionally, adding a hollow extension onto the outlet of the blast nozzle spaces the water atomization nozzles even further away from the target surface to increase contact time of the atomized water droplets with the dust and thereby improve dust control, operator visibility. The collimation tube also provides for a more concentrated hot spot on the targeted surface to remove contaminants therefrom.

DETAILED DESCRIPTION OF THE INVENTION

Figure 1:
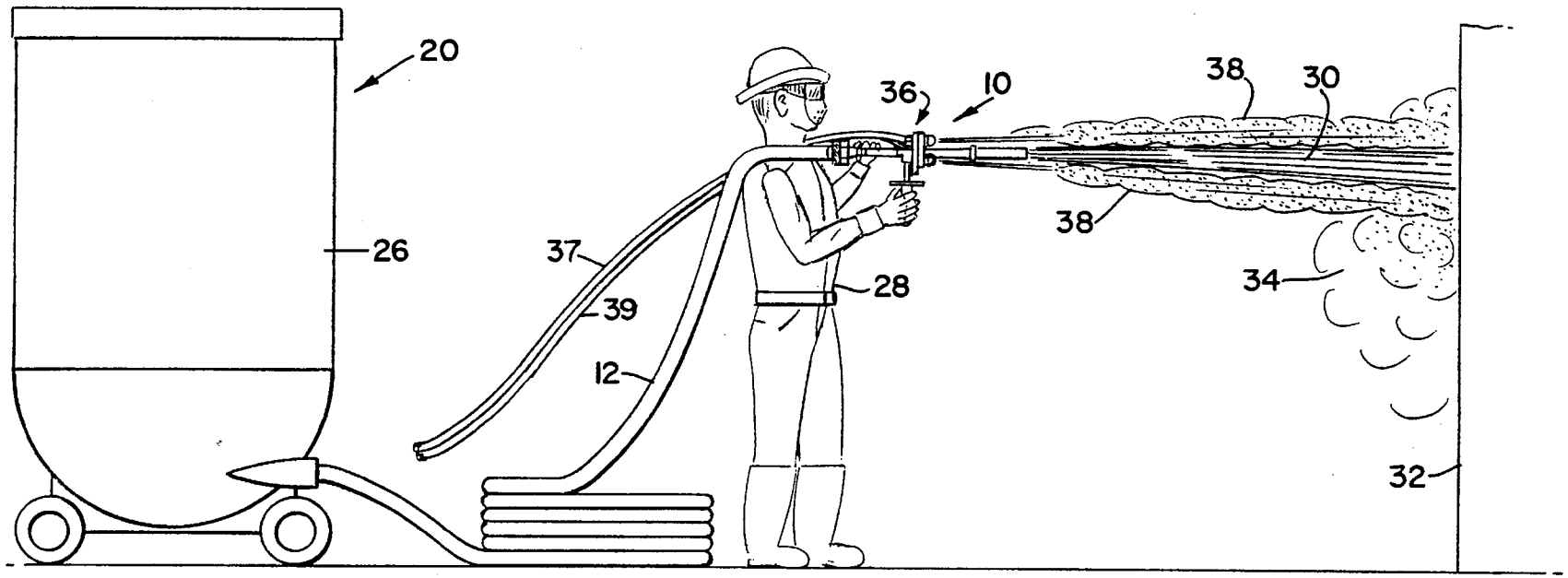
FIG. 1 is a pictorial view of the blast cleaning nozzle of the present invention in use by an operator.

Referring initially to FIG. 1, a typical air-propelled abrasive blast system includes a blast nozzle 10 that is connected to the outer end of a high pressure flexible supply hose 12 which carries the blast media mixed with air from dispensing device 20 to the inlet of blast nozzle 10. A normally closed "deadman" control valve (not shown) is mounted adjacent the blast nozzle 10 and functions to prevent operation of the blast nozzle unless the control valve is held open by depressing a spring-loaded lever.

Dispensing device 20 generally includes a supply of abrasive particles such as sand or, more particularly, sodium bicarbonate, contained in a tank or pot 26 which is sized to hold a selected quantity of abrasive. Compressed air applied to tank 26 carries the blast media to supply hose 12. The flow of abrasive blast media from tank 26 into the compressed air stream and through supply hose 12 is typically controlled via a metering and shut-off valve (not shown). The supply hose 12 extends from the tank 26 and typically is passed over the shoulder of the operator designated by reference numeral 28 and is connected to blast nozzle 10. There are various means to meter the abrasive blast media into the compressed air stream and any of such metering devices are operable in the present invention. A particularly preferred metering device utilizes differential air pressure and is described in commonly assigned U.S. Pat. Nos. 5,081,799 and 5,083,402 herein incorporated by reference.

As shown in FIG. 1, exiting blast nozzle 10 is a stream of abrasive blast particles entrained in a pressurized air stream indicated by reference numeral 30 which contacts surface 32. As the abrasive blast particles contact surface 32, these particles strip the coating, dirt, etc. from the surface and along with this stripped material are deflected from surface 32. The abrasive blast media which is often very friable, such as sodium bicarbonate, breaks into smaller pieces as it contacts surface 32 and forms a dust cloud 34 as the particles are deflected from the surface 32. In accordance with the present invention, blast nozzle 10 further includes a water atomizer 36 which directs a spray of atomized water 38 at this cloud of dust to coalesce the dust particles and cause such particles to precipitate to the ground to suppress the formation of dust cloud 34 and prevent the dispersion of the dust particles away from the surface 32 and into the surrounding environment. Pressurized water and air are supplied to water atomizer 36 via hoses 37 and 39, respectively from a supply (not shown). Water atomizer 36 includes at least two atomization nozzles placed around blast nozzle 10. The atomization nozzles form an atomized water mist which substantially surrounds abrasive stream 30 without substantially interfering with stream 30 prior to contact of the abrasive particles with surface 32.

Figures 2, 3, 4:
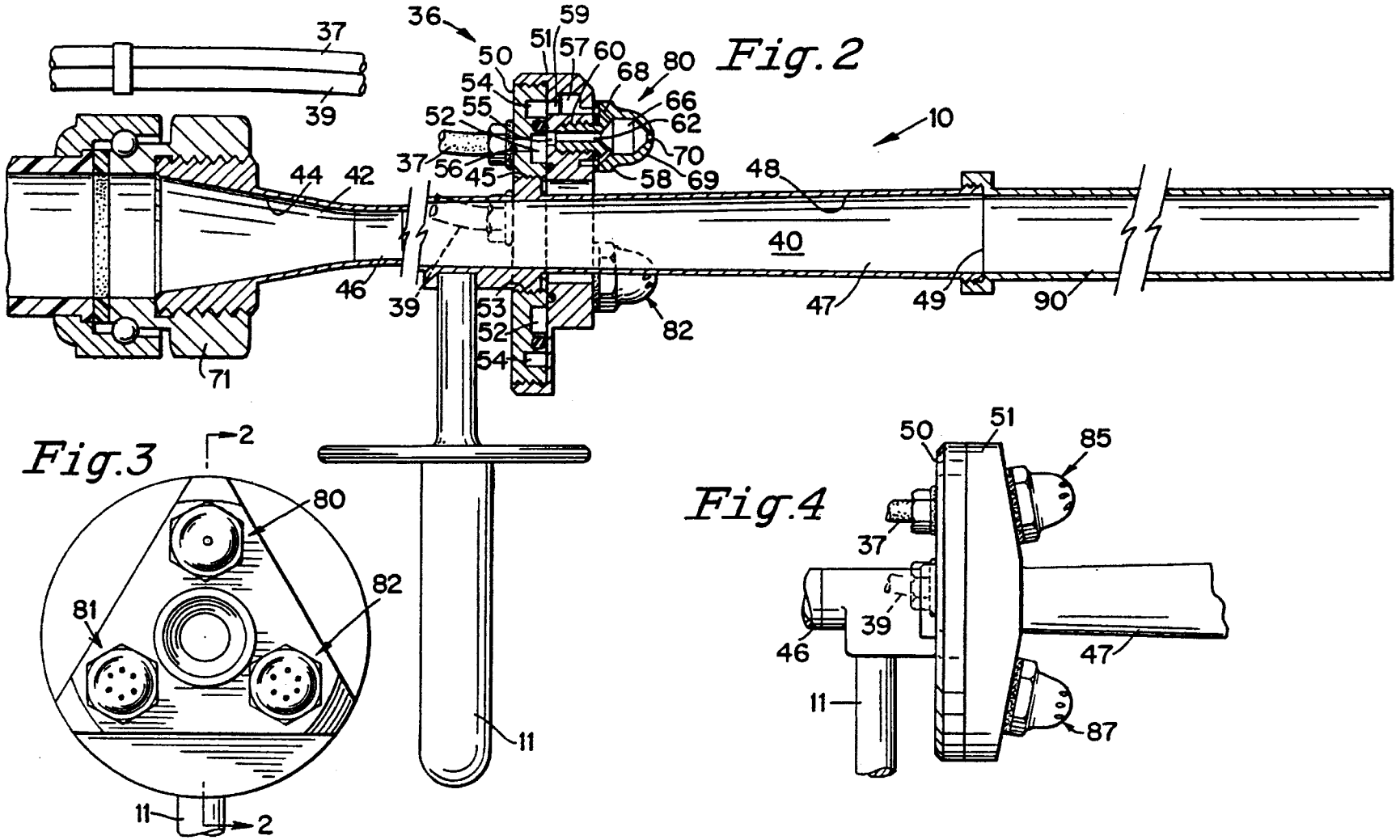
FIG. 2 is a longitudinal cross section of the blast nozzle of this invention.
FIG. 3 is an end elevation taken along lines 3—3 of FIG. 2, showing an arrangement of the atomization nozzles.
FIG. 4 is a partial side elevation of the blast nozzle showing an alternative orientation of the water atomization nozzles.

FIG. 2 illustrates the improved blast nozzle of this invention. As shown therein, the abrasive blast system includes a blast nozzle 10 exemplified by a standard round nozzle containing a bore 40 formed therein defining a longitudinal axis. Handle 11 extends from nozzle 10 and can be gripped by the operator as shown in FIG. 1. Bore 40 includes an inlet portion 42 which contains converging surface 44, a throat 46 and an outlet portion 47 which contains diverging surface 48 which extends to outlet 49. The venturi effect formed by surfaces 44 and 48 and throat 46 serves to increase the velocity of the blast media out of outlet 49 of blast nozzle 10 to an extremely high velocity effective to clean or remove adhered coatings, scale, etc. from the surface being targeted. For protection against the eroding effects of the blast media, on the interior surfaces of the blast nozzle protective inserts or coatings may be advantageously provided on surfaces 44 and 48 and within throat area 46. Such coatings or inserts may advantageously comprise ceramics such as tungsten carbide or silicon nitride as erosion resistant materials. Blast nozzle 10 may alternatively be formed of such ceramic materials. A particularly preferred blast nozzle is one formed from reaction-bonded silicon nitride and is disclosed in PCT Application No. PCT/US93/09409, filed Oct. 7, 1993. If only a soft abrasive is to be used, such as sodium bicarbonate, the blast nozzle can be cast or otherwise formed from stainless steel.

To suppress the formation of dust which forms when the abrasive blast media contacts and then strips contaminants from the targeted surface, there is provided on the blast nozzle 10 of the present invention a water atomizer 36. Water atomizer 36 includes at least two water atomization nozzles. Three atomization nozzles 80, 81 and 82, are shown in FIG. 3. Additional water atomization nozzles can be added, if desired, although three of such nozzles have been found sufficient to reduce dust formation. Additional water atomization nozzles may not necessarily provide sufficiently improved dust control to warrant the added weight to the blast nozzle assembly.

As shown in FIG. 2 each water atomization nozzle is secured to a nozzle manifold 50 which is machined, cast or preferably releasably attached (threaded) onto blast nozzle 10 via the pair of threads 45. Manifold 50 may also be formed separately and welded onto the exterior of blast nozzle 10. The use of manifold 50 is advantageous since it eliminates the need to provide separate supplies of water and air to each atomization nozzle. The nozzle manifold 50 includes a ring-shaped water supply groove 52 and separate ring-shaped supply groove 54 for pressurized air. Water supply groove 52 communicates with water supply hose 37 via port 56 while air supply groove 54 communicates with supply hose 39 via a port (not shown) in manifold 50. Each water atomization nozzle includes a nozzle support body 51 which is cast or molded with manifold 50 or preferably threaded onto nozzle manifold 50 via the pair of threads 53. Nozzle support body 51 includes a water inlet port 55 and a separate inlet port 57 for pressurized air. Water inlet port 55 communicates with water supply groove 52 and air inlet port 57 communicates with air supply groove 54 via air passage 59 in nozzle support body 51. A nozzle atomizer tip 58 is threaded via pair of threads 60 into the nozzle support body 51 so as to attach the nozzle atomizer tip 58 to blast nozzle 10 and can be interchanged to accommodate various blast media as will be further explained below. Inlet bore 62 in nozzle atomizer tip 58 is contiguous with and forms a continuous bore with water inlet port 55. Water supplied by hose 37 to supply groove 52 travels to water inlet port 55 and passes through inlet bore 62 and is directed into mixing chamber 66 contained in nozzle atomizer tip 58. Nozzle atomizer tip 58 further includes inlet air passage 68 which communicates with air inlet port 57 contained in nozzle support body 51. Air supplied from hose 39 to supply groove 54, passes through passage 59 to air inlet port 57 and air passage 68 which also communicates with mixing chamber 66. Thus, water entering mixing chamber 66 is mixed with the air entering chamber 66 through air passage 68. The air/water mixture leaves the nozzle atomizer tip 58 under pressure through exit ports 70 contained in atomizing cap 69 to form an atomized water spray which is directed at the deflecting abrasive blast media as shown in FIG. 1 so as to suppress dust formation and suppress dispersal of a dust cloud away from the surface into the nearby environment.

Nozzle atomizer tip 58 and atomizing cap 69 are interchangeable structures and can be changed to another configuration so as to adjust for differing types of blast media being used or varying blasting conditions. For example, an atomizing cap 69 can be used which is configured with one or more, preferably, a plurality of exit ports 70 so as to produce a mist of the atomized water droplets directed at the targeted surface to suppress dust. Changing atomizing cap 69 to a different configuration can change the atomized cloud pattern to accommodate changing process conditions. The atomization nozzles can be provided from any number of commercial suppliers of atomizing nozzles. A particular useful nozzle tip is manufactured by Bete Fog Nozzle Inc., Greenfield, Mass. and provided from their ¼ XA Series of atomizer nozzles. Thus, atomizer nozzles or fog nozzles which have different means to atomize water relative to the above described structure can be used so long as the proper droplet size can be formed. For example, it has been found that nozzles which externally mix the air and water can provide useful flat triangular atomized water clouds to control dust during blasting, particularly on large flat surfaces, i.e., rail cars, large tanks, etc.

With the blast nozzle containing the single water atomizer nozzle of the parent application, it was important that the single water atomizer nozzle be constantly directed at the deflection point of the media from the targeted surface. The supply hose 12 which feeds the blast nozzle 10 with the air and blast media mixture is made of a very thick and stiff rubber in order to withstand the abrasive action of the media passing therethrough. Consequently, the supply hose cannot be readily twisted and turned to orient the blast nozzle 10 in a direction such that the single water atomizer nozzle was always directed at the proper deflection point of the media from the targeted surface. Accordingly, it was preferable to include a swivel joint to connect blast nozzle 10 to the supply hose 12 and allow the blast nozzle 10 to be rotated around the longitudinal axis of the supply hose so as to properly orient the water atomizer nozzle at all times during blasting to control dust formation.

Since the present blast nozzle contains more than one water atomization nozzle which surround the abrasive stream as well as the hot spot on the targeted surface, there is no critical need for the swivel to orient the atomized water droplets. However, a swivel 71 can be added to aid the operator in manipulating the blast nozzle and handle, if desired. The type of swivel joint 71, per se, is not part of the invention and any commercial swivel joint can be utilized. It is important that if used the swivel joint provide a substantially unrestricted passage between the supply hose and the blast nozzle so as to not adversely affect the flow of blast media therethrough and to maintain a homogenous concentration of the blast media throughout the air stream and the total cross sectional area of the inlet of blast nozzle 10. Thus, all joints should preferably butt together to provide an interior passage which is uniform and does not include gaps which can yield eddies and turbulent flow of the air and blast media through the hose and blast nozzle. An example of a commercial swivel joint which can be utilized with the blast nozzle of the present invention is one manufactured by OPW Engineered Systems, Mason, Ohio, Aluminum Model 25 with a 1¼ inch bore. Alternatively, it is also possible to maintain blast nozzle 10 at a fixed position relative to the supply hose 12 and have atomizer nozzle 36 positioned so as to swivel about the longitudinal axis of the blast nozzle. An advantage of this arrangement is the ability to minimize the contamination of the swivel by the blast media.

In order to control the dust formation, it is important that the water droplets from the water atomizer 36 have the proper size. Thus, water atomization nozzles producing water particles of 200 microns at most, preferably 15 microns to submicron particle size are useful. Typically, commercial water atomization nozzles are capable of producing a water droplet size of 15–50 microns. The particle size of the atomized water droplets to be used should be minimized. Water droplets which have too great of size cannot attach and coalesce readily with the dust particles to suppress dust formation and precipitate the media particles from the air. Moreover, water droplets which are too large interfere with the blast media particles in the blast stream prior to substrate impact. This interaction reduces the velocity of the media particles and consequently decreases cleaning performance.

Droplet size can be controlled by a variety of factors. The relative amount of water and air introduced into the water atomizer nozzle can be used to control the water droplet size. Thus, water pressures of 20 to 200 psi and flow of at least 0.02 to about 1.0 gallon per min. and air pressures of 20 to 150 psi and flows of greater than 10 CFM have been found useful to produce atomized water droplets of appropriate size especially to reduce sodium bicarbonate dust. An excessive air pressure can significantly reduce water flow due to back pressure and decrease the number of water droplets. It has been found, for example, that a water pressure of 50 psi and an air pressure of 100 psi in which the water passes through each water atomization nozzle at 0.15 gallon per minute is most useful to suppress dust from sodium bicarbonate media having a size of 50 microns to submicron size after impact with the targeted surface. It has also been found that slight variations in the water and air pressure do not substantially affect the productivity of the stripping action. Thus, water droplet size can be controlled without adversely affecting productivity. Moreover, as stated previously, different atomization nozzle configurations, e.g. exit port configurations, can be used to provide the necessary droplet sizes.

The blast nozzle of the present invention is improved over the prior art blast nozzle with single water atomization nozzle in that the water atomizer of the present invention which includes more than one water atomization nozzle produces more atomized water droplets than the previous blast nozzle, and consequently, can achieve greater dust reduction around the targeted surface. Additionally, water atomizer 36 in blast nozzle 10 of the present invention is now positioned at a location away from nozzle outlet 49. In general, water atomizer 36 containing the three water atomization nozzles 80, 81 and 82 is spaced approximately halfway between the nozzle throat 46 and the nozzle outlet 49. By moving the water atomizer 36 away from the nozzle outlet, the atomized water droplets are provided with a greater travel time to the targeted surface and thus provided with additional contact time with the dust particles which surround the targeted surface. Moreover, finer atomized water droplets are produced which spread out providing better coverage the further the atomized water droplets move away from the atomization nozzles.

As stated previously, it is also possible to vary the density of the atomized water particles which issue from the respective water atomization nozzles. Thus, as shown in FIG. 3, water atomization nozzles 81 and 82 contain six exit ports 70 so as to produce a dense atomized water mist which can reduce dust formation in the environment of the targeted surface. Water atomization nozzle 80, however, can contain only one exit port 70 so as to reduce the amount of mist formed along the line of sight of the operator so as to aid the visibility of the operator during the blast cleaning operation. The use of only one exit port 70 on one of the water atomization nozzles is an option only and is not critical to the invention. The number of exit ports 70 or port geometry, e.g., hole, slot, etc., in each of the water atomization nozzles can be varied as desired by simply using a different atomization cap 69.

Another feature of the present invention so as to improve dust control is the optional addition of a collimation tube 90 placed onto the outlet of blast nozzle 10. The collimation tube 90 concentrates the blast media exiting the outlet of the blast nozzle and thus provides for improved contaminant removal at the hot spot where the abrasive contacts the targeted surface at a precise moment. Without the collimation tube, the blast media tends to expand from the outlet of the blast nozzle, dispersing so as to increase the area of the hot spot relative to the area of the nozzle outlet. The wider dispersal of the blast media may result in the formation of a non-uniform hot spot such that not all of the contaminants are removed therein requiring the operator to direct the abrasive against areas previously targeted. The collimation tube 90 concentrates the blast media in a smaller hot spot but the contaminants are readily removed in the hot spot area so that little or no repeat sweeps of a targeted area have to be made by the operator. Importantly, the collimation tube 90 also places the blast nozzle further away from the targeted surface and accordingly, allows the operator more reach which is advantageous in overhead or floor cleaning. As well, the collimation tube 90 moves the atomization nozzles further away from the targeted surface providing an even greater contact time between the atomized water droplets and the dust which is formed and, again, allowing the formation of a finer atomized water droplets as the atomized water exits the water atomization nozzles and is directed toward the targeted surface. The collimation tube 90 is an optional feature and is not critical to improve dust control although the addition of this tube has the advantages discussed above.

As stated previously, it is important that the atomized water droplets directed from the water atomization nozzles do not substantially interfere with the blast media stream which is directed from the outlet of the blast nozzle to the targeted surface. While there likely will be some contact between the abrasive media stream and the atomized water droplets, by forming finer water droplets, the atomized water droplets will not reduce to any significant effect the velocity of the abrasive media stream leaving the nozzle. As shown in FIG. 4, one method of insuring that the atomized water droplets do not interfere with the abrasive stream leaving the nozzle is to tilt the water atomization nozzles at an acute angle away from the longitudinal axis of the abrasive stream as it exits the blast nozzle. This orientation of the water atomization nozzles also provide for better coverage and operator visibility. As shown in FIG. 4, water atomization nozzles 85 and 87 are deflected at an acute angle away from the longitudinal axis of the blast nozzle and the abrasive blast stream which exits the nozzle. It is important to minimize the angle of deflection of the water atomization nozzles away from the longitudinal axis of the blast stream so as to insure that the atomized water droplets come in contact with the dust which is formed upon contact of the abrasive particles with the targeted surface. An angle of approximately 5° to 30° from the longitudinal axis is useful.

Unlike the prior art dust control methods where a water stream is either injected internally into the blast nozzle or sprayed from a nozzle external of the blast nozzle onto the blast stream, the water atomization nozzles of the present invention do not substantially reduce performance or, in other words, adversely effect the stripping action of the blast media. This has been found particularly true for the sodium bicarbonate blast media which is water soluble and less dense than sand and can be greatly decelerated by the addition of the prior art water sprays. The deceleration of the blast media particles toward the targeted surface greatly reduces the production and stripping action of the blast media. Thus, unlike the prior art, the atomized water spray of the present invention is sufficient to effectively control the dust and the water droplets formed are of such a small size that they do not adversely affect the blast media leaving the blast nozzle and directed toward the targeted surface. Moreover, the direction of the atomized water toward the deflected dust and not into the blast media stream also is advantageous in minimizing interaction between the two steams and, thus, maintaining good productivity of the blast media.

The blast nozzle containing the water atomizer nozzle of the present invention can be advantageously used with any type of friable blast media. Thus, while it has been disclosed that the blast nozzle of the present invention is most useful with soft friable blast media such as sodium bicarbonate, the blast nozzle apparatus is also useful with hard friable blast media such as sand. Thus, the blast nozzle apparatus is useful to control the silica dust which results upon blasting with sand. Moreover, the blast nozzle apparatus of this invention is useful to remove coatings, scale and the like from any type of surface including the softer surfaces described above such as soft metals including aluminum and plastic surfaces and, as well, hard surfaces such as hard metals including steel. Moreover, the particular configuration of the blast nozzle, per se, can be changed without adversely affecting the improvements found with the water atomizer nozzle to control dust. Thus, although the standard round nozzle is disclosed and illustrated in the accompanying figures, it is to be well understood that other configurations of blast nozzles can be used with equal advantage, i.e., fan nozzle.

The following examples are provided for the purpose of illustrating the invention only and are not to be so construed as to limit the appended claims solely to the embodiments described in these examples.

EXAMPLE 1

In this example, dust control utilizing the combination of the present invention comprising a blast nozzle and a four-tip water atomizer was compared with dust control utilizing the same blast nozzle but containing only a single water atomization nozzle. The blast nozzles each had a ½ inch diameter orifice and a ¾ inch diameter outlet. The outlet or diverging section of the blast nozzle was 10 in. long.

The blast media was carried through the blast nozzle to the targeted surface by compressed air at 60 psi. The media flow rate through the blast nozzle was 3 lbs. per minute. The blast angle relative to the targeted surface was 70° and the outlet of the blast nozzle was spaced 8 in. away from the targeted surface. The blast media was sodium bicarbonate. Blasting was continued for 5 minutes.

The air entering the water atomizer of each combination apparatus had a pressure of 60 psi and a volume flow rate of 35 CFM. The water was directed to each water atomizer at 55 psi. The volume flow rate of water to the water atomizers of the respective blast nozzle combinations is set forth in Table 1.

Blasting was conducted in a blast room 10 ft. high, 9 ft. wide and 42 ft. length. Thirty feet from the targeted surface, a Graseby Anderson High Volume Air Sampler was placed to gather the dust which was formed and drifted away from the targeted surface. Dust collection was continued for 10 min. at a volume flow rate of 27 CFM. The dust collected was weighed and the density of the dust determined relative to the amount of air issuing from the blast nozzle. The density of the dust collected is shown in Table 1 for the two combinations tested and for three types of sodium bicarbonate media.

TABLE 1

SINGLE-TIP VS. 4-TIP ATOMIZER TEST

| Water Flow Rates | Dust Concentration (MG/M$^3$) Single-tip (0.27 GPM) | Four Tip (1.31 GPM) |
|---|---|---|
| Maintenance[1] | 171 | 90 |
| Maintenance XL[2] | 152 | 80 |
| Maintenance XL[3] with Suprakleen | 172 | 76, 72 |

[1]Armex ® Sodium Bicarbonate media, average size 200 microns, Church & Dwight, Princeton, NJ.
[2]Armex ® SBC media, average size 200–300 microns
[3]Armex ® SBC media, 200–300 microns + surfactant As can be seen, the combination of the present invention containing multiple water atomization nozzles greatly reduced the dust which was formed. Approximately half as much dust remained air-borne utilizing the four tip water atomizer of this invention.

EXAMPLE 2

In this example, the production rates of various blast nozzles were compared. Thus, the production rate of a blast nozzle without any water atomization nozzles for dust control, a blast nozzle containing a single tip water atomization nozzle and a blast nozzle containing a water atomizer containing three water atomization nozzles were determined and compared. The blast nozzle configurations were the same for all the nozzles and were equivalent to that used in the previous example.

Sodium bicarbonate blast media having an average diameter of about 200 microns was utilized to strip an epoxy paint coated on steel at a thickness of about 12 to 14 mils. The volume of paint stripped defined as mils square feet per minute was determined at various flow rates of the sodium bicarbonate media for each of the blast nozzles used. Air pressure for carrying the media was 60 psi while the air and water pressures for the atomization nozzles was as in Example 1. For the combination containing the three tip water atomizer, the atomization nozzle tips were angled 20° away from the longitudinal axis of the blast nozzle.

Figure 5:
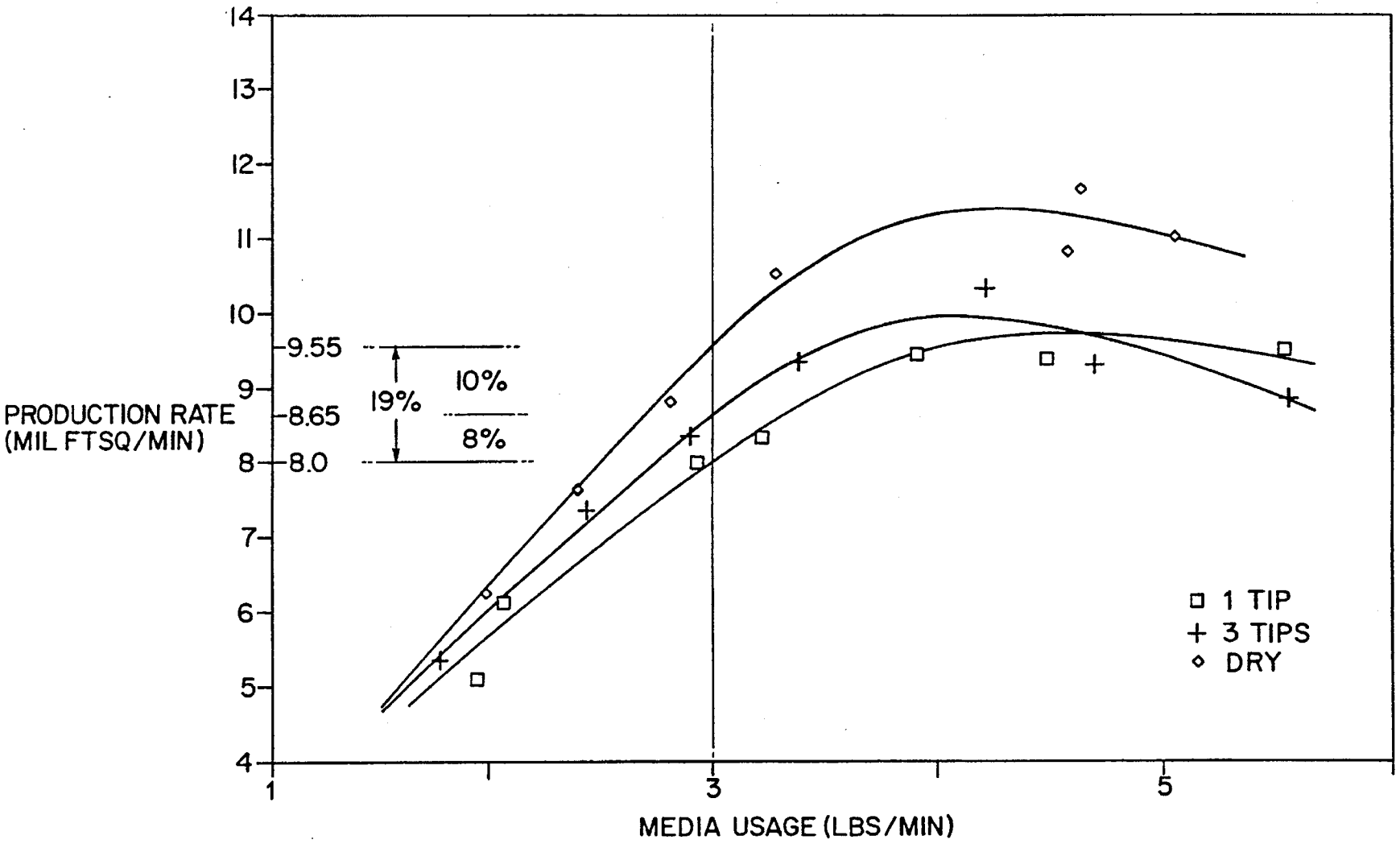
FIG. 5 is a graph comparing the performance of the blast nozzle of the present invention with the performance of a blast nozzle without a water atomizer and a blast nozzle containing a single water atomizer attached to the blast nozzle.

The performance data is shown in FIG. 5. As shown therein, at the typical rate of media usage for sodium bicarbonate (3 lbs. per min.), the blast nozzle with the three tip water atomizer had a production rate of approximately 8% better than the blast nozzle containing the single tip water atomizer. Although the dry blasting nozzles without the water atomization nozzles yielded the best performance, a substantial amount of dust was formed.

What is claimed is:

1. A blast nozzle and water atomizer combination for directing a stream of abrasive particles against a targeted surface for the removal of surface contaminants therefrom and for reducing dust formation comprising: a blast nozzle including a means to accelerate a mass of abrasive particles from the inlet of said blast nozzle to the outlet thereof and a means to atomize water with air attached to the exterior of said blast nozzle, said means to atomize water comprising multiple atomization nozzles spaced around the exterior of said blast nozzle, each atomization nozzle including means to mix separate streams of water and air and including outlet means separate from said blast nozzle outlet and positioned to direct said atomized water to a location adjacent said targeted surface without substantially interfering with said mass of abrasive particles as said abrasive particles are directed from the outlet of said blast nozzle to said targeted surface.

2. The combination of claim 1 wherein each of said water atomization nozzles includes an air inlet port for receiving compressed air, a water inlet port for receiving pressurized water, means to mix said water and air and wherein said outlet means to direct said atomized water adjacent to the targeted surface comprises at least one exit port in communication with said mixing means.

3. The combination of claim 2 including a plurality of said exit ports in communication with said mixing means.

4. The combination of claim 2 wherein said air inlet port and said water inlet port are separate and wherein said mixing means comprises a hollow chamber communicating with both said air and water inlet ports.

5. The combination of claim 1 wherein said means to accelerate said abrasive particles comprises a hollow converging inlet portion, a downstream hollow diverging outlet portion and a venturi orifice placed intermediate of said converging and diverging portions.

6. The combination of claim 5 wherein said water atomizer means is placed on the exterior of said diverging portion.

7. The combination of claim 1 including a supply hose attached to said blast nozzle and which communicates with a supply of abrasive particles and means other than said supply hose to rotate said water atomizer means about the longitudinal axis of said blast nozzle.

8. The combination of claim 1 including a rigid supply hose attached to said blast nozzle and which communicates with a supply of abrasive particles, and a swivel joint placed intermediate of said supply hose and said blast nozzle to allow said blast nozzle to rotate about the longitudinal axis of said blast nozzle.

9. The combination of claim 2 wherein said water atomizer means includes a manifold containing a water supply port and a separate air supply port for receiving separate streams of water and air, said separate water and air ports in said manifold communicating with said water inlet port and air inlet port, respectively, in each of said water atomization nozzles.

10. The combination of claim 6 wherein said water atomizer means is located upstream of and spaced from the outlet of said blast nozzle.

11. The combination of claim 10 wherein said water atomizer means is placed approximately halfway between said venturi orifice and said outlet of said blast nozzle.

12. The combination of claim 1 wherein said blast nozzle is made of a ceramic material.

13. The combination of claim 12 wherein said blast nozzle is formed of a reaction bonded silicon nitride.

14. The combination of claim 1 wherein said blast nozzle is formed of stainless steel.

15. The combination of claim 1 wherein at least one of said water atomization nozzles is orientated at an acute angle from the longitudinal axis of said blast nozzle.

16. The combination of claim 15 wherein said acute angle is from about 5° to 30°.

17. The combination of claim 15 wherein all of said atomization nozzles are orientated at said acute angle away from the longitudinal axis of said blast nozzle.

18. The combination of claim 1 further including a collimation tube placed onto the outlet of said blast nozzle, said collimation tube comprising a hollow tube having an inlet juxtaposed with the outlet of said blast nozzle and an outlet to direct the abrasive particles to the targeted surface, said collimation tube not substantially diverging from the inlet to the outlet thereof.

19. The combination of claim 1 wherein said means to atomize water comprises three of said atomization nozzles.

20. The combination of claim 1 wherein said means to atomize water comprises four of said atomization nozzles.

* * * * *